US006572040B1

(12) United States Patent
Brown, Jr.

(10) Patent No.: US 6,572,040 B1
(45) Date of Patent: Jun. 3, 2003

(54) COAL GRINDING, CLEANING AND DRYING PROCESSOR

(75) Inventor: Charles Kepler Brown, Jr., Richmond, VA (US)

(73) Assignee: HiMicro Incorporated, Richmond, VA (US)

( * ) Notice: Subject to any disclaimer, the term of this patent is extended or adjusted under 35 U.S.C. 154(b) by 0 days.

(21) Appl. No.: 09/830,587

(22) PCT Filed: Nov. 9, 1999

(86) PCT No.: PCT/US99/26309

§ 371 (c)(1),
(2), (4) Date: Aug. 15, 2001

(87) PCT Pub. No.: WO00/27533

PCT Pub. Date: May 18, 2000

Related U.S. Application Data

(60) Provisional application No. 60/107,666, filed on Nov. 9, 1998.

(51) Int. Cl.[7] ..... B02C 7/02

(52) U.S. Cl. ..... 241/162; 241/261.2; 241/261.3; 241/275; 241/296; 241/298

(58) Field of Search ..... 241/27, 29, 261.2, 241/261.3, 296, 297, 275, 162, 163

(56) References Cited

U.S. PATENT DOCUMENTS 1,624,037 A * 4/1927 Butler ..... 241/261
2,585,881 A * 2/1952 Walker ..... 241/198.1
3,411,724 A * 11/1968 Noe ..... 241/188.2
3,950,147 A 4/1976 Funk et al.
4,030,893 A * 6/1977 Keller ..... 208/424
4,159,073 A 6/1979 Liller
4,304,573 A 12/1981 Burgess et al.
4,341,352 A 7/1982 Liller
4,355,586 A * 10/1982 Brown ..... 110/229
4,461,625 A 7/1984 Smith et al.
4,691,867 A * 9/1987 Iwako et al. ..... 241/21
4,695,371 A 9/1987 Starbuck
4,923,843 A * 5/1990 Saforo et al. ..... 502/415
5,236,596 A * 8/1993 Greenwald, Sr. ..... 210/696
5,275,631 A * 1/1994 Brown et al. ..... 44/631
5,449,122 A * 9/1995 Berger et al. ..... 241/261.2
5,575,824 A * 11/1996 Brown et al. ..... 44/505
5,597,127 A * 1/1997 Brown ..... 241/188.2
5,637,122 A * 6/1997 Brown ..... 44/505
5,704,559 A * 1/1998 Froberg et al. ..... 241/261.3
5,795,484 A * 8/1998 Greenwald, Sr. ..... 210/696
6,286,771 B1 * 9/2001 Brown et al. ..... 241/162

* cited by examiner

*Primary Examiner*—William Hong
(74) *Attorney, Agent, or Firm*—Jacobson Holman PLLC

(57) ABSTRACT

A coal processing mill incorporates integral systems for coarse coal dewatering, grinding, injection of a peptizing agent into the ground coal stream before it enters an agitation zone (where the peptization process takes place), passing the treated coal and the peptized clay and ash through a separating valve and passing the separated coal on to final drying. In other embodiments, ash and pyrites (of much higher density than coal) are separated from coal and the coal can then be fired.

19 Claims, 5 Drawing Sheets

COAL GRINDING, CLEANING AND DRYING PROCESSOR

CROSS-REFERENCE TO RELATED APPLICATIONS

The present patent application is based on, and claims priority from, U.S. provisional Application No. 60/107,666, filed Nov. 9, 1998, which is incorporated herein by reference in its entirety.

BACKGROUND OF THE INVENTION

1. Field of the Invention

The present invention relates to mills for grinding and separating ash and pyrites from coal. More specifically, the invention relates to such mills, which incorporate systems for cleaning and drying coal as well as grinding it.

2. Related Art

In preparing coal for briquetting or pelletizing, ash materials and moisture interfere with successful bonding of finely ground particles into a cohesive mass that will maintain its integrity with storage and handling.

Clay in the ash attracts and holds water. It generally helps maintain a water content of around 30% by weight. This is undesirable because it lowers the Btu value, resulting in increased shipping costs and less boiler efficiency.

In prior art coal processing technology, coarse dewatering takes place at one site. The coarsely dewatered coal is then transported to a grinding site, thence to a peptizing tank, then on to a dewatering screen process or centrifugal operation, followed by aeration to achieve sufficient dryness for maximum bonding results. No ash removal takes place in such prior art technology, unless it is done by wet methods as a separate step.

In addition, in some parts of the wold, coal has extremely high ash content, as much as 35 percent. Currently, conventional milling is done at high maintenance expense to both mills and boilers. Boilers in particular require costly de-slagging to remove encrustations from molten ash. Milling followed immediately, in the same rotating device, by ash separation provides a compact, integrated unit for replacing existing conventional mills as a way to substantially reduce the costs of combusting high-ash coals.

SUMMARY OF THE INVENTION

The objects of this invention are several: to dewater incoming wet coal; to fine-grind the coal; to remove minerals and clay components of ash so that the powdered coal can be more thoroughly dried by centrifugal means, down to around 5% by weight, and thus more amenable to briquetting or pelletizing; or to remove ash from coal prior to direct firing.

Experience has shown that by peptizing the clay into a colloidal dispersion by washing the coal particles with vigorous agitation in a soap-like agent, such as sodium hexametaphosphate, the fine platelets of clay can be removed from the small coal particle surfaces making them hydrophobic, thus making it easier to remove the clinging water. The colloidal mix of clay can then be centrifugally separated from the coal. The insoluble mineral portion of the ash can also be centrifuged from the coal. After the peptized clay and mineral containing ash is split off and ejected the clean but still damp coal continues on through an intensive centrifugal drying action.

All of these functions—coarse coal dewatering, grinding between high speed counter rotating rotors, injection of the peptizing agent into the ground coal stream before it enters the violent agitation zone (where the peptization process takes place), having the treated coal pass through the peptized clay and ash removal point and then on to the final drying phase for the coal—are performed by respective means that are all incorporated into one integral milling unit.

The processor technology preparing coal for pelletizing in accordance with the present invention is not only superior because of what it does and how it does it, but also because of its relative simplicity. There is no coarse dewatering at one site, transporting to a grinding site, thence to a peptizing tank, then on to a dewatering screen process or centrifugal operation, followed by aeration to achieve sufficient dryness for maximum bonding results. The present invention also accomplishes ash removal, which is not achieved in the prior art technology.

Similarly, in preparing high ash coal for direct firing, there is no present technology that performs efficient, high-capacity, ultra-fine milling to liberate high proportions of ash from coal followed immediately by dry separation, nor efficient, stand-alone, high capacity, dry ash separation means.

Other objects, features and advantages of the present invention will be apparent to those skilled in the art upon a reading of this specification including the accompanying drawings.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
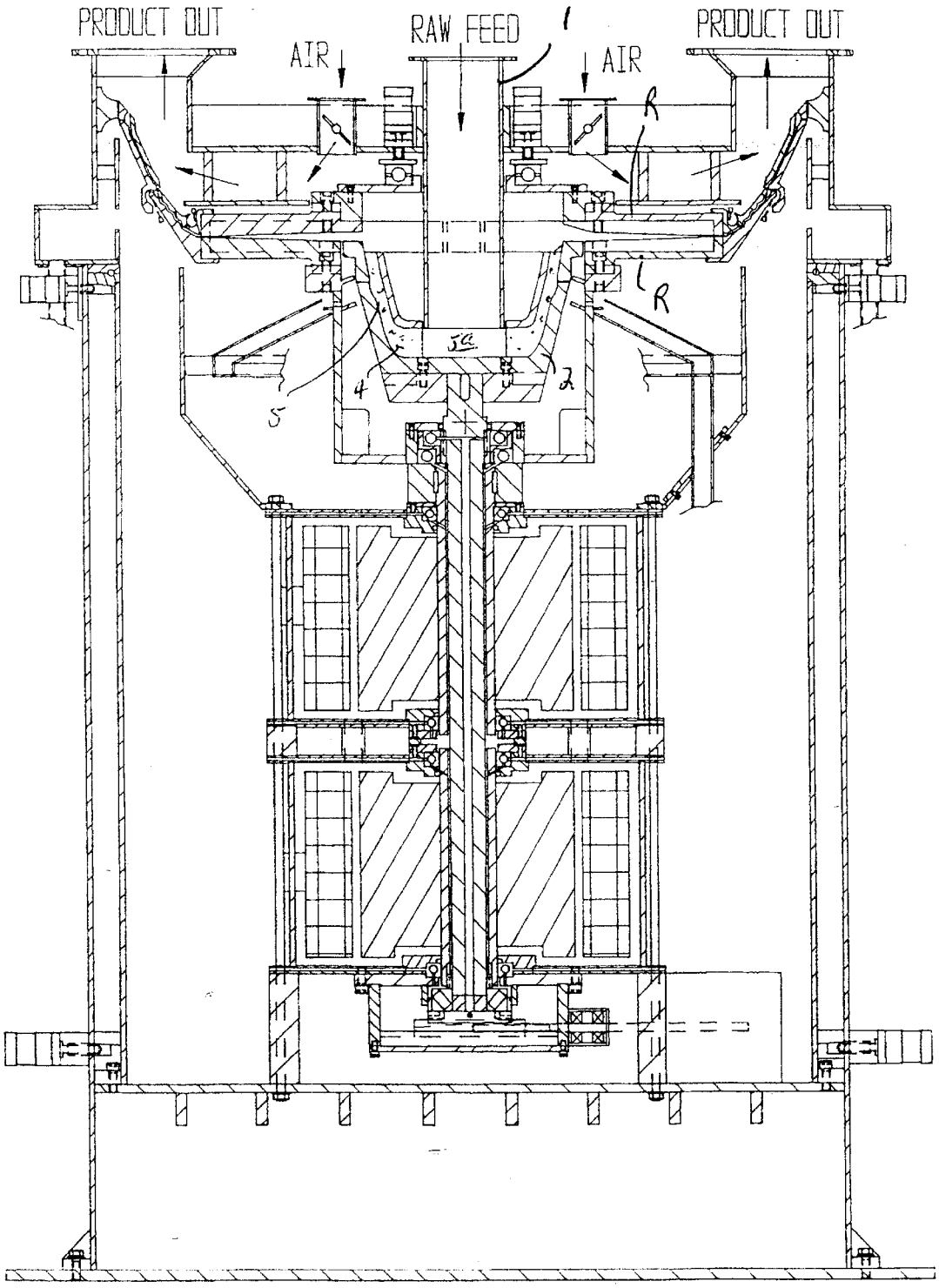
FIG. 1 is a transverse cross-sectional view of a coal mill incorporating a coal grinding, cleaning, and drying processor in accordance with the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

Referring now to FIG. 1, there is shown a mill of general form including drives and rotors into which the present invention is incorporated. The drives and rotors may be of the type disclosed in co-pending U.S. patent application Ser. No. 09/302,359, filed Apr. 30, 1999, of Charles Kepler Brown. Jr. (the inventor of the present application) and David Kepler Brown, and U.S. Pat. No. 5,275,631 to the same inventors, which are incorporated herein by reference in its entirety; while the mill itself may be of the type disclosed in co-pending international application No. PCT/US99/19504, filed Aug. 26, 1999, of the same inventors, which is also incorporated herein by reference in its entirety.

Figure 2:
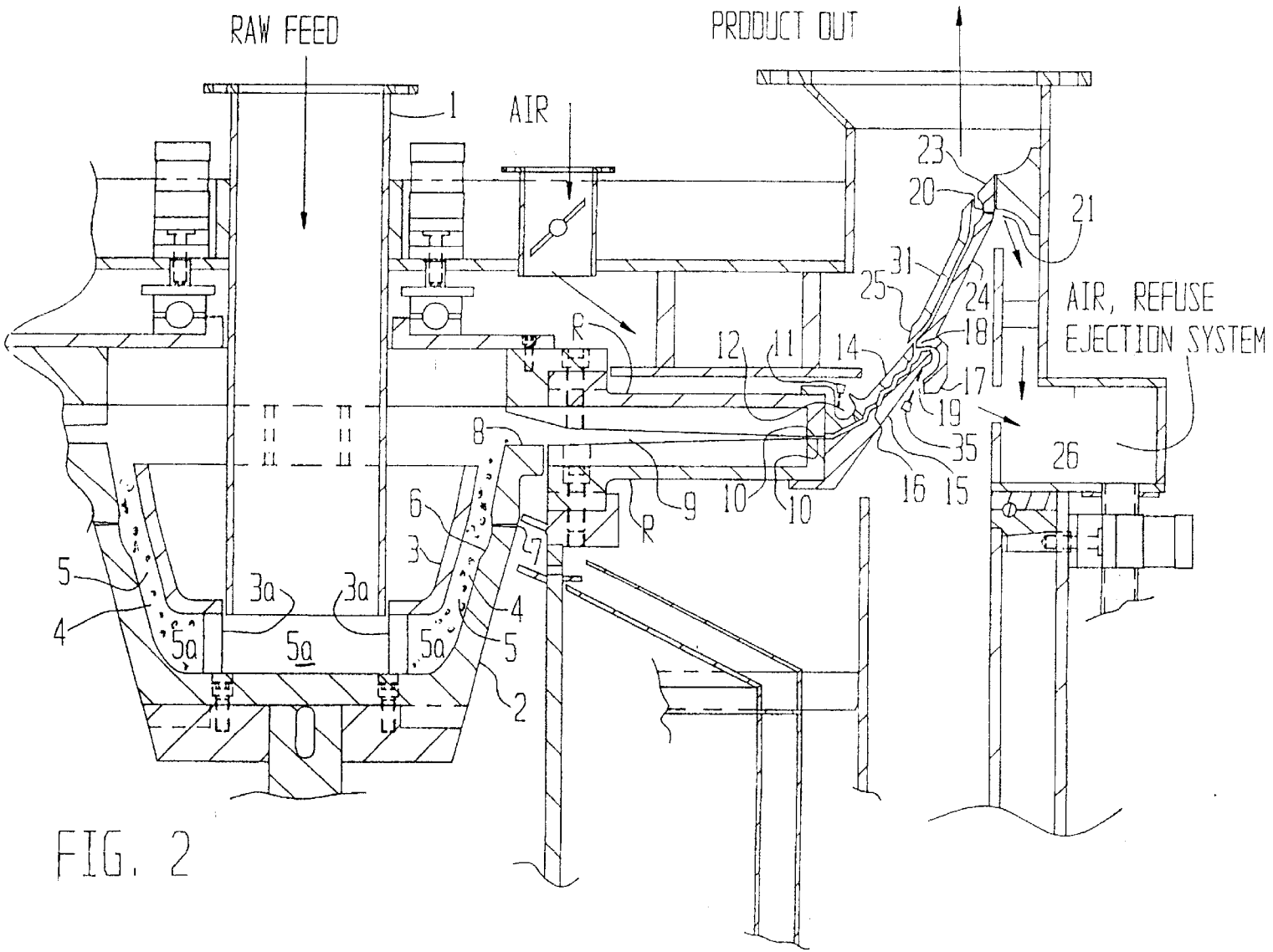
FIG. 2 is a cross-sectional view of the processing rotors of the coal grinding, cleaning, and drying processor in accordance with the present invention.

FIG. 2 shows a cross section of the processing rotors R involved in the previously described actions. The rotors R are driven by motors in clockwise and counter-clockwise relation with each other. All of these means are housed in a single and appropriate housing.

Incoming coal, which in the first embodiment typically might be drawn from a storage pond of waste coal, is fed into the mill M through a feed pipe 1 positioned at the top of the mill M along the axis of rotation of the rotors R. The coal is deposited in a dewatering bowl 2 positioned below and spaced downwardly from the outlet of the feed pipe 1. A cup 3 is provided surrounding the lower portion of the feed pipe 1, the bottom of the cup 3 being co-terminous with the outlet of the feed pipe 1. Both the bowl 2 and the cup 3 are of approximately frusto-conical shape. The cup 3 is connected to the bowl 2 by means of connecting bars 3*a*.

The exterior surface of the cup 3 is spaced inwardly from the interior surface of the bowl 2 to define an approximately frusto-conical space 5, including a zone 5*a* between the outer bottom of the cup 3 and the inner bottom of the bowl 2. The cup 3 directs process material radially outward toward the inner wall of the bowl 2 under centrifugal force, and then forms a relatively thin (for quick drainage) shell-like layer 4 of wet coal in the space 5.

The centrifugal force developed by the mass at the bottom of the cup 3 in the zone 5*a* exerts pressure on the bottom of the shell 4, urging it upward as fast as the incoming coal will displace it. The angle of the external slope of the cup 3 can be set to provide an upward force component just low enough that the coal would not move except for the centrifugal force generated in the zone 5*a*. As long as the incoming coal continues the flow through, milling will continue.

The interior side wall of the bowl 2 is provided with an annular groove 6 and a plurality of radial ports 7 formned through the side wall at the upper edge of the annular groove 6. The upwardly migrating coal passes over the annular groove 6 in the bowl 2, while the centrifuged water traveling up the inner surface collects in the annular groove 6 and ejects through the ports 7. The dewatered coal continues on up and over a rim 8 formed at the upper peripheral edge of the bowl 3 and enters the grinding section 9 between the rotors R.

Several styles of rotor configuration for grinding can be utilized here based on a variety of coal characteristics. One such style is shown in U.S. Pat. No. 5,275,631; others are shown in co-pending U.S. patent application Ser. No. 09/302,359.

As the ground coal sprays out from between the lips 10 formed at the perimeters of the rotors R, it enters a peptizing zone defined between opposed, counter-rotating upper and lower agitating rings 14 and 15 concentric with the rotors R and abutting the lips of the rotors R. Rings 14 and 15 have approximately the form of truncated cones.

Figure 3:
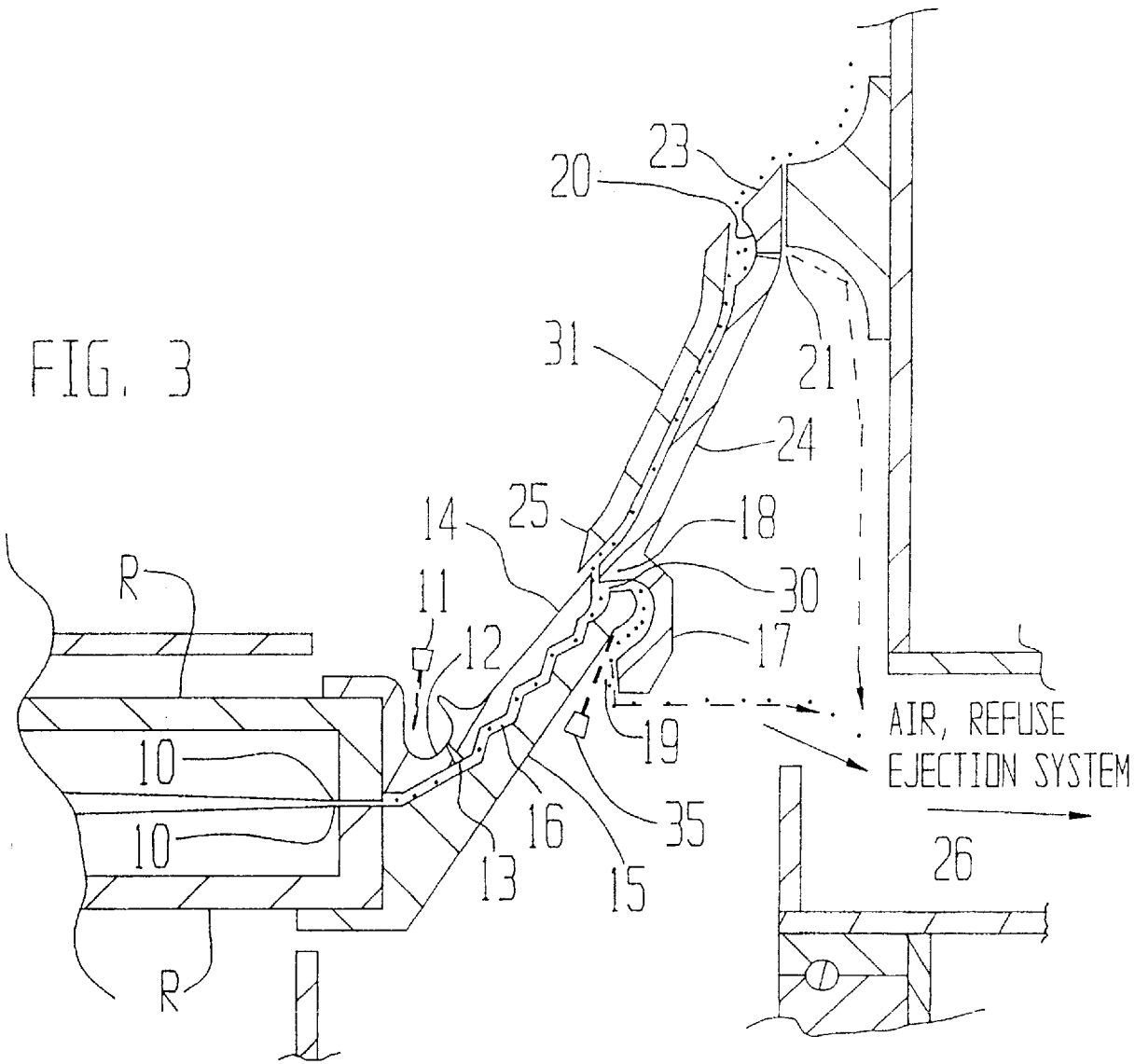
FIG. 3 is an enlarged view of the cleaning (separating) and drying zones of the processing rotors of FIG. 2.

The coal is saturated with an incoming stream of peptizing agent by way of a nozzle 11 spraying into an annular groove or cavity 12 in the upper ring 14 and draining into the space between the rings 14 and 15 through a plurality of port holes 13 (shown in FIG. 3) formed in and spaced appropriately around the groove 12. Centrifugal force is the pumping agent. The peptizing agent can alternatively be injected in similar manner further back in the rotor system.

The saturated mix is driven centrifugally out and up between the rings 14 and 15. Various rippled or ridged patterns 16 can be incorporated into the facing surfaces of the rings 14 and 15 to provide an extremely vigorous scrubbing action on the saturated coal layer.

An annular collar enclosing the upper edge of the lower ring 15 defines a manometer-like valve 17 having a looped fluid path and an exit leg 19 therethrough. The surface of the collar at the inlet of the valve 17 defines a weir-like barrier 18 opposite the upper edge of the upper ring.

By the time the fluidized, peptized well-scrubbed mass reaches the branch 30 (shown in FIG. 3) between the barrier 18 and the valve 17, the dense ash particles are firmly following the surface of the ring 15 and displacing the less dense clean coal to an upper stratum. Close to 2000 g's of centrifugal force, the fluid nature of the mix, and the density difference of coal and ash ensure that stratification preceding separation will occur. At branch 30, the peptized, clay-carrying fluid ejects through the manometer-like valve 17, while the layer of insoluble, more dense mineral ash particles bank up against the barrier 18. The unbalanced forces resulting from the bank-up move the ash material out through the loop and exit leg 19 of the valve 17. Liquid from a nozzle 35, injected into the loop of the valve 17, maintains free movement of solids through the loop. Water is presently considered to be the preferred liquid, although other liquids can be used. While this action relieves the rings 14 and 15 of the ash, it also blocks the flow of pure, less dense coal and forces it to flow up and over the barrier 18.

It is possible that materials other than coal, comprising constituents of differing densities, could be processed in this way. The zone between the facing surfaces of the rings 14 and 15 is formed on an angle of between 45 and 85 degrees, depending on the size distribution of the material being processed, the amount of liquid present, and the rotation rate, all of which may vary with the feed stock and the purpose for processing. For coal, currently, an optimum angle is thought to be between 45 and 85 degrees, and most likely within 50 to 65 degrees.

The damp, cleaned coal is further dried in a drying zone 31 upstream of the peptizing zone. The drying zone is defined by a cup 24 extending upwardly from the collar defining the valve 17. The cup 24 has approximately the form of a truncated cone, with its interior sidewall forming an angle of about 50 to 70 degrees with a horizontal plane. It is configured in a manner similar to the dewatering bowl 2, in that the interior side wall of the cup 24 is provided with an annular groove 20 and a plurality of radial ports 21 formed through the side wall at the upper edge of the annular groove 20. In the cup 24, water collects in the annular groove 20, and drains out through the ports 21. The clean, dry coal extrudes up over the rim 23 of the cup 24. A cover section 25 having approximately the form of a truncated cone is provided over the cup 24, and entrains the coal movement so it does not blow away before it is dried. The cover 25 is mounted on the cup 24 and travels with it.

The wastewater and ash collect in an annular channel 26 positioned radially outwardly of the rotors R and below the outlets of the ports 21, and is drained or flushed to a waste pond. The coal goes on to be briquetted or pelletized.

Figure 4:
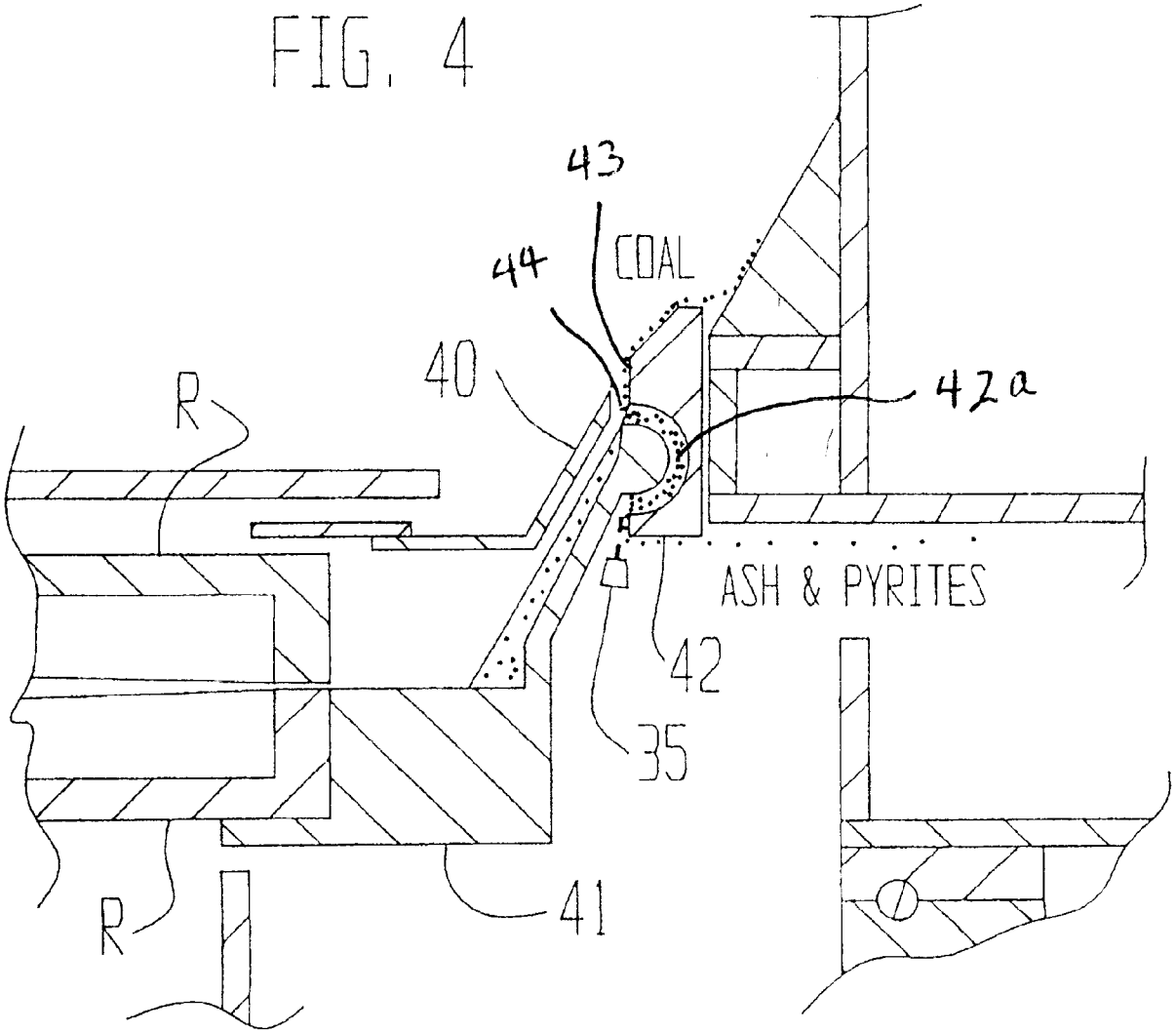
FIG. 4 is a cross-sectional view of the cleaning zone (separator) of a second embodiment of the invention for removing ash and pyrites from coal in preparation for direct boiler firing.

FIG. 4 illustrates an embodiment in which grinding is followed by separation, without peptizing. This embodiment is preferred when the coal product is not to be pelletized or briquetted, but instead is to be fired directly after cleaning. In this embodiment, a ring 41 is concentric with and abuts the lip of the lower rotor R. An annular shield 40 and a valve 42 are connected by radial ties (not shown) to the ring 41. The surface 43 if the valve 42 immediately above the inlet of the valve 42 acts as a weir similar to the barrier 18 described in connection with FIGS. 2 and 3. It will be appreciated that the facing surfaces of the shield 40 and the ring 41 are smooth, rather than patterned as in the case of the facing surfaces of the rings 14 and 15 of the first embodiment. A nozzle 35 is provided, similar to the nozzle 35 described in connection with FIGS. 2 and 3.

By the time the moving mass of coal and ash particles reaches the branch 44 between the weir 43 and the valve 42, the dense ash particles are firmly following the surface of the ring 41 and displacing the less dense clean coal to an upper stratum. At the branch 45, the coal passes over the weir 43 (no peptizing having taken place), while the more dense mineral ash particles bank up against the weir 43. The unbalanced forces resulting from the bank-up move the ash material out through the loop 42*a* and the exit leg of the valve 42. The curve of the loop 42*a* of through the valve 42 is in the same direction as the flow of less dense particles. Liquid from the nozzle 35, injected into the loop 42*a,* maintains free movement of solids through the loop.

Figure 5:
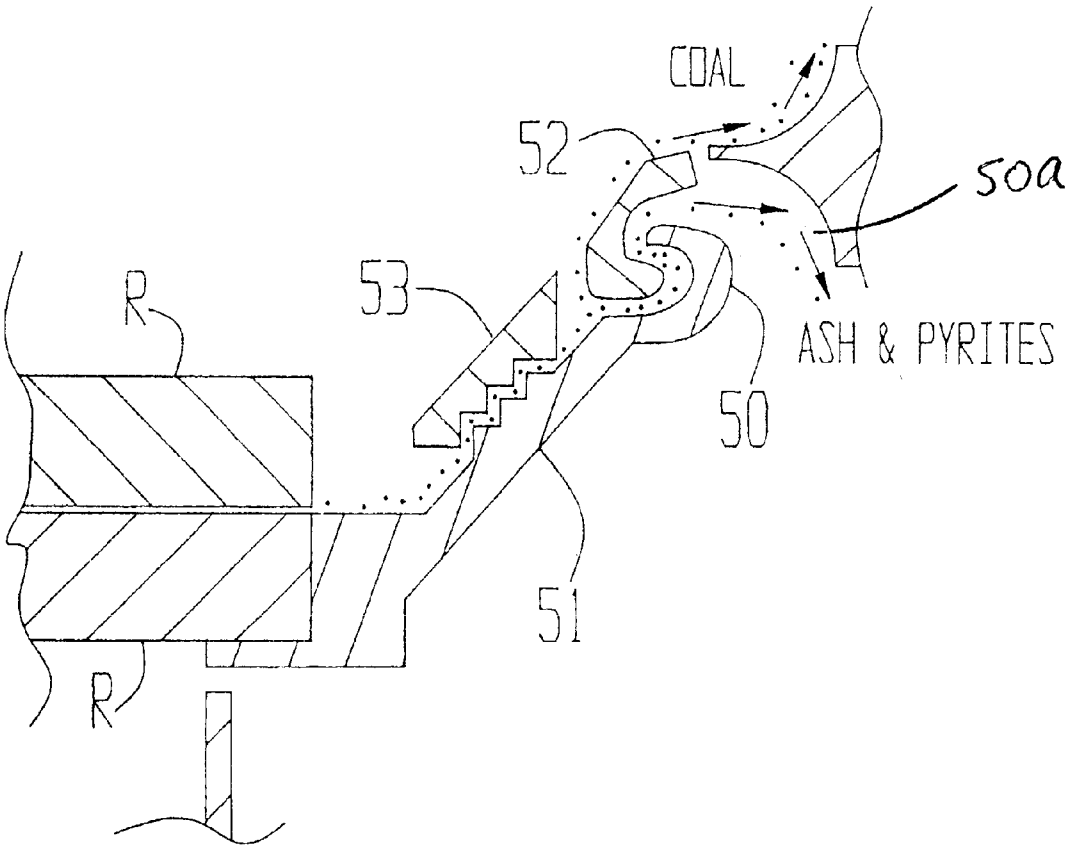
FIG. 5 is a cross-sectional view of the separator of a third embodiment for removing ash and pyrites from coal, in which the higher density constituent moves in the same general direction (upward) as the material feeding into the separator.

Referring now to FIG. 5, there is shown a third embodiment also for use where the coal product is not to be pelletized, and where grinding therefore is followed by separation, without peptizing. In this embodiment, a rotor ring 51 is provided concentric with and abuts the lip of the lower rotor R. The rotor ring 51 is integrated with the loop 50*a* of the separator valve 50, and waste material is directed along an upward path instead of downwardly. In this case, the curve of the loop 50*a* through the valve 50 is in the opposite direction from the flow of less dense particles. Less dense coal travels over a weir ring 52 provided over the upper edge of the rotor ring 51. An annular shield 53 and the weir ring 52 are connected by radial ties (not shown) to the ring 51.

Modifications and variations of the above-described embodiments of the present invention are possible., as appreciated by those skilled in the art in light of the above teachings. It is therefore to be understood that, within the scope of the appended claims and their equivalents, the invention may be practiced otherwise than as specifically described.

What is claimed is:

1. A coal processing mill comprising:

means for grinding the coal, means for peptizing the clay component of ash materials in the coal, and means for centrifugally removing the peptized clay ash component along with the insolvent remaining portions of ash.

2. The coal processing mill of claim 1, further comprising means for dewatering coal entering the mill.

3. The coal processing mill of claim 2, wherein the means for dewatering incoming coal comprises:

a feed pipe having an inlet and an outlet;

a rotatable dewatering bowl of approximately frusto-conical shape positioned below and spaced downwardly from the outlet of the feed pipe; and a cup of approximately frusto-conical shape surrounding the lower portion of the feed pipe, the bottom of the cup being co-terminous with the outlet of the feed pipe, the exterior surface of the cup being spaced inwardly from the interior surface of the bowl to define an approximately frusto-conical space between their facing surfaces, the cup being rotatable to direct process material radially outward toward the inner wall of the bowl under centrifugal force to form a relatively thin, shell-like layer of wet coal in the space.

4. The coal processing mill of claim 3, wherein the interior side wall of the bowl is provided with an annular groove and a plurality of radial ports formed through the side wall at the upper edge of the annular groove, whereby the upwardly migrating coal passes over the annular groove in the bowl, while the centrifuged water traveling up the inner surface collects in the annular groove and ejects through the ports.

5. The coal processing mill of claim 1, wherein the grinding means comprises a system of counter-rotating rotors.

6. The coal processing mill of claim 1, wherein the peptizing means comprises:

opposed, counter-rotating upper and lower agitating rings positioned outwardly of the grinding means, the rings having approximately the form of truncated cones; and means for saturating the coal with a stream of peptizing agent.

7. The coal processing mill of claim 6, wherein the upper ring includes an annular groove in its inner surface and a plurality of port holes formed in and spaced around the groove and draining into the space between the rings, and wherein the saturating means comprises a nozzle directed to spray a stream of peptizing agent into the annular groove in the upper ring.

8. The coal processing mill of claim 6, wherein the facing surfaces of the rings form an angle of approximately 45 to 85 degrees with a horizontal plane.

9. The coal processing mill of claim 6, wherein textured patterns are incorporated into the facing surfaces of the rings.

10. The coal processing mill of claim 6, wherein the ash removing means comprises an annular collar enclosing the upper edge of the lower ring to define a valve adapted to eject the peptized, clay-carrying fluid, the surface of the collar at the inlet of the valve defining a weir-like barrier opposite the upper edge of the upper ring, the barrier being adapted to block the insoluble, more dense mineral ash particles and forcing the flow of less dense coal up and over the barrier.

11. The coal processing mill of claim 6, further comprising means for centrifugally drying the remaining cleaned coal down to beneficial low levels of moisture.

12. The coal processing mill of claim 11, wherein the cleaned coal drying means comprises:

a cup extending upwardly from the collar defining the valve, the cup having approximately the form of a truncated cone, and a cover section provided over the cup and travelling with it, the cover section having approximately the form of a truncated cone.

13. The coal processing mill of claim 12, wherein the interior sidewall of the cup is provided with an annular groove and a plurality of radial ports formed through the sidewall at the upper edge of the annular groove.

14. The coal processing mill of claim 12, wherein the interior sidewall of the cup forms an angle of between 50 and 70 degrees with a horizontal plane.

15. The coal processing mill of claim 1, wherein the ash removing means comprises:

means for separating the peptized, clay-carrying fluid, the more dense mineral ash particles, and the less dense clean coal from each other, and means for blocking the insoluble, more dense mineral ash particles while permitting the upward flow of less dense coal, and means for ejecting the peptized, clay-carrying fluid and the mineral ash particles.

16. The coal processing mill of claim 1, further comprising means for centrifugally drying the remaining cleaned coal down to beneficial low levels of moisture.

17. A mill for processing material having components of differing densities, the mill comprising:

means for blocking the more dense component while permitting the upward flow of less dense material, means for conducting the more dense component through a loop, means for injecting a liquid into the loop to maintain free movement of the particles of the more dense component within the loop, and means defining a separate stream for diversion of the more dense particles, wherein the mass of the particles of the more dense component in the loop and the lubricity of the liquid injected into the loop resist entry into the loop of particles of the less dense component while permitting entry into the loop of particles of the more dense component due to the capacity of their greater mass to exert force through the loop, displacing one or more particles of a similar size and mass at the other end of the loop, thereby completing the diversion of more dense particles from less dense particles into the separate stream.

18. The mill of claim 17, wherein the loop has a curve in the same direction as the flow of less dense particles.

19. The mill of claim 17, wherein the loop has a curve in the opposite direction from the flow of less dense particles.

* * * * *